US006065160A

United States Patent [19]

Winn

[11] Patent Number: 6,065,160

[45] Date of Patent: May 23, 2000

[54] ADJUSTABLE CLOSET FLANGE

[76] Inventor: Michael R. Winn, P.O. Box #96, Gratz, Pa. 17030

[21] Appl. No.: 09/314,910

[22] Filed: May 20, 1999

[51] Int. Cl.[7] ..... E03D 11/00

[52] U.S. Cl. ..... 4/252.1; 4/252.4; 4/252.5; 4/252.3; 285/56; 285/414

[58] Field of Search ..... 4/252.1, 252.2, 4/252.3, 252.4, 252.5, 252.6; 285/56, 57, 58, 59, 60, 42, 412, 414

[56] References Cited

U.S. PATENT DOCUMENTS

| | | | |
|---|---|---|---|
| 872,331 | 12/1907 | Dreier | 4/252.4 |
| 903,280 | 11/1908 | Farrell | 4/252.4 |
| 1,042,465 | 10/1912 | Oakes | 285/57 |
| 3,775,780 | 12/1973 | McEwen | 4/252.4 |
| 5,185,890 | 2/1993 | Dismore et al. | 4/252.5 |

*Primary Examiner*—Steven O. Douglas
*Assistant Examiner*—Khoa Huynh

[57] ABSTRACT

A adjustable closet flange for permitting adjustment of the depth of a closet flange connecting a toilet to a drain conduit. The adjustable closet flange includes a tubular lower conduit with open top and bottom ends, and exterior and interior surfaces. The interior surface of the lower conduit has a threaded region located adjacent the top end of the lower conduit. The lower conduit also has an outwardly radiating annular mounting flange adjacent the top end of the lower conduit. A tubular upper conduit is proved having open upper and lower ends, and inner and outer surfaces. The outer surface of the upper conduit has a threaded region adjacent the lower end of the upper conduit. The lower end of the upper conduit is inserted into the top end of the lower conduit with the threaded region of the upper conduit threadedly engaging the threaded region of the lower conduit. The outer surface of the upper conduit has an annular outer groove therearound adjacent the upper end of the upper conduit. An annular bolt down flange is rotatably disposed about the upper conduit in the outer groove to permit free rotation of the bolt down flange about the upper conduit in the outer groove.

8 Claims, 2 Drawing Sheets

ADJUSTABLE CLOSET FLANGE

BACKGROUND OF THE INVENTION

1. Field of the Invention

The present invention relates to closet flanges and more particularly pertains to a new adjustable closet flange for permitting adjustment of the depth of a closet flange connecting a toilet to a drain conduit.

2. Description of the Prior Art

The use of closet flanges is known in the prior art. More specifically, closet flanges heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,115,554; U.S. Pat. No. 903,280; U.S. Pat. No. 4,827,539; U.S. Pat. No. Des. 334,051; U.S. Pat. No. 5,232,250; U.S. Pat. No. 5,377,361; U.S. Pat. No. 4,648,139; and U.S. Pat. No. 872,331.

While these devices fulfill their respective, particular objectives and requirements, the aforementioned patents do not disclose a new adjustable closet flange. The inventive device includes a tubular lower conduit with open top and bottom ends, and exterior and interior surfaces. The interior surface of the lower conduit has a threaded region located adjacent the top end of the lower conduit. The lower conduit also has an outwardly radiating annular mounting flange adjacent the top end of the lower conduit. A tubular upper conduit is proved having open upper and lower ends, and inner and outer surfaces. The outer surface of the upper conduit has a threaded region adjacent the lower end of the upper conduit. The lower end of the upper conduit is inserted into the top end of the lower conduit with the threaded region of the upper conduit threadedly engaging the threaded region of the lower conduit. The outer surface of the upper conduit has an annular outer groove therearound adjacent the upper end of the upper conduit. An annular bolt down flange is rotatably disposed about the upper conduit in the outer groove to permit free rotation of the bolt down flange about the upper conduit in the outer groove.

In these respects, the adjustable closet flange according to the present invention substantially departs from the conventional concepts and designs of the prior art, and in so doing provides an apparatus primarily developed for the purpose of permitting adjustment of the depth of a closet flange connecting a toilet to a drain conduit.

SUMMARY OF THE INVENTION

In view of the foregoing disadvantages inherent in the known types of closet flanges now present in the prior art, the present invention provides a new adjustable closet flange construction wherein the same can be utilized for permitting adjustment of the depth of a closet flange connecting a toilet to a drain conduit.

The general purpose of the present invention, which will be described subsequently in greater detail, is to provide a new adjustable closet flange apparatus and method which has many of the advantages of the closet flanges mentioned heretofore and many novel features that result in a new adjustable closet flange which is not anticipated, rendered obvious, suggested, or even implied by any of the prior art closet flanges, either alone or in any combination thereof.

To attain this, the present invention generally comprises a tubular lower conduit with open top and bottom ends, and exterior and interior surfaces. The interior surface of the lower conduit has a threaded region located adjacent the top end of the lower conduit. The lower conduit also has an outwardly radiating annular mounting flange adjacent the top end of the lower conduit. A tubular upper conduit is proved having open upper and lower ends, and inner and outer surfaces. The outer surface of the upper conduit has a threaded region adjacent the lower end of the upper conduit. The lower end of the upper conduit is inserted into the top end of the lower conduit with the threaded region of the upper conduit threadedly engaging the threaded region of the lower conduit. The outer surface of the upper conduit has an annular outer groove therearound adjacent the upper end of the upper conduit. An annular bolt down flange is rotatably disposed about the upper conduit in the outer groove to permit free rotation of the bolt down flange about the upper conduit in the outer groove.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable closet flange apparatus and method which has many of the advantages of the closet flanges mentioned heretofore and many novel features that result in a new adjustable closet flange which is not anticipated, rendered obvious, suggested, or even implied by any of the prior art closet flanges, either alone or in any combination thereof.

It is another object of the present invention to provide a new adjustable closet flange which may be easily and efficiently manufactured and marketed.

It is a further object of the present invention to provide a new adjustable closet flange which is of a durable and reliable construction.

An even further object of the present invention is to provide a new adjustable closet flange which is susceptible of a low cost of manufacture with regard to both materials and labor, and which accordingly is then susceptible of low prices of sale to the consuming public, thereby making such adjustable closet flange economically available to the buying public.

Still yet another object of the present invention is to provide a new adjustable closet flange which provides in the apparatuses and methods of the prior art some of the advantages thereof, while simultaneously overcoming some of the disadvantages normally associated therewith.

Still another object of the present invention is to provide a new adjustable closet flange for permitting adjustment of the depth of a closet flange connecting a toilet to a drain conduit.

Yet another object of the present invention is to provide a new adjustable closet flange which includes a tubular lower conduit with open top and bottom ends, and exterior and interior surfaces. The interior surface of the lower conduit has a threaded region located adjacent the top end of the lower conduit. The lower conduit also has an outwardly radiating annular mounting flange adjacent the top end of the lower conduit. A tubular upper conduit is proved having open upper and lower ends, and inner and outer surfaces. The outer surface of the upper conduit has a threaded region adjacent the lower end of the upper conduit. The lower end of the upper conduit is inserted into the top end of the lower conduit with the threaded region of the upper conduit threadedly engaging the threaded region of the lower conduit. The outer surface of the upper conduit has an annular outer groove therearound adjacent the upper end of the upper conduit. An annular bolt down flange is rotatably disposed about the upper conduit in the outer groove to permit free rotation of the bolt down flange about the upper conduit in the outer groove.

Still yet another object of the present invention is to provide a new adjustable closet flange that eliminates the need to tear up flooring and rework plumbing to re-install a closet flange for a toilet when installing thicker subfloors to support different flooring materials.

Even still another object of the present invention is to provide a new adjustable closet flange that lets the closet flange be taken apart when installing new subflooring without having to rework the plumbing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
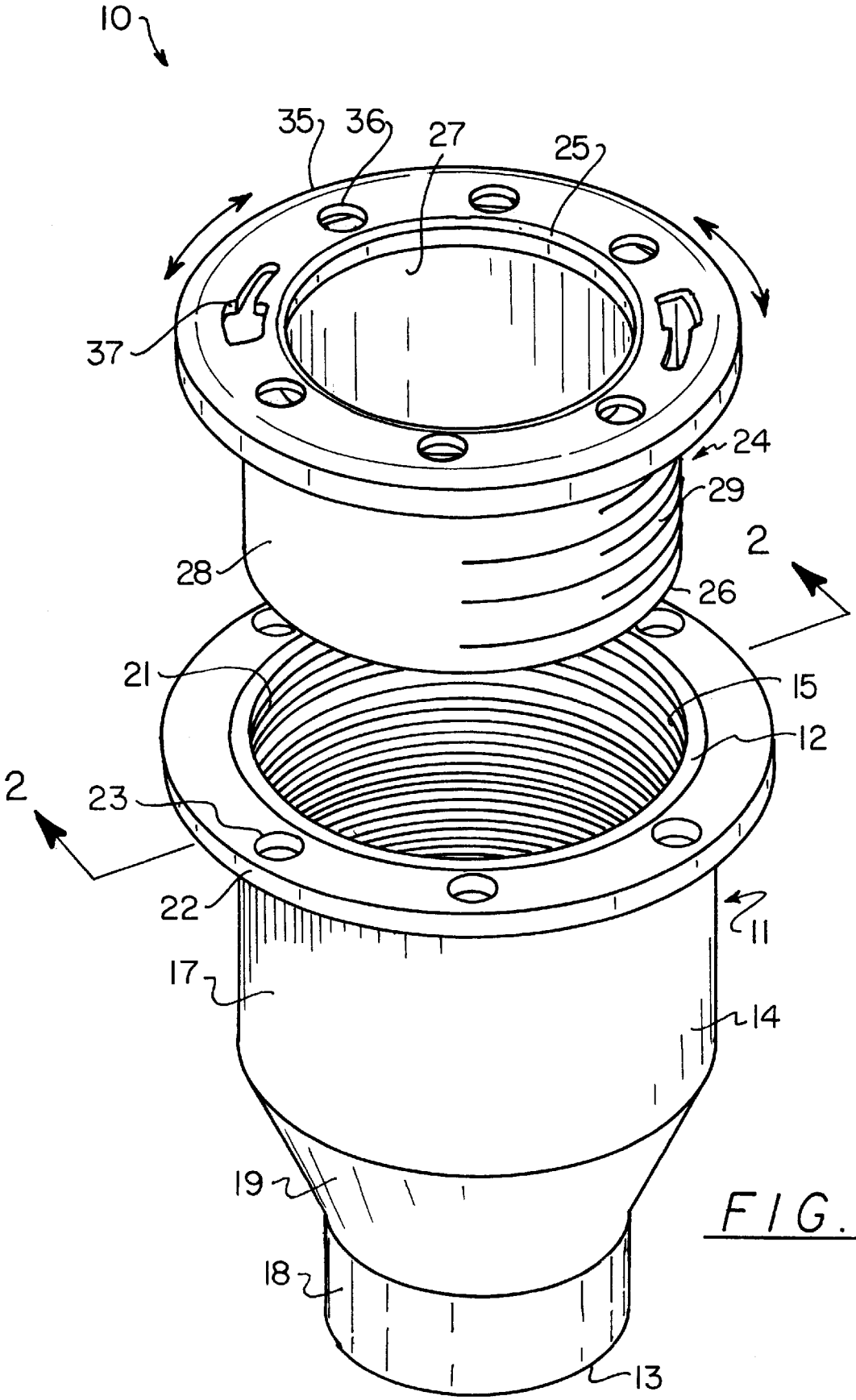
FIG. 1 is a schematic exploded perspective view of a new adjustable closet flange according to the present invention.
Figure 2:
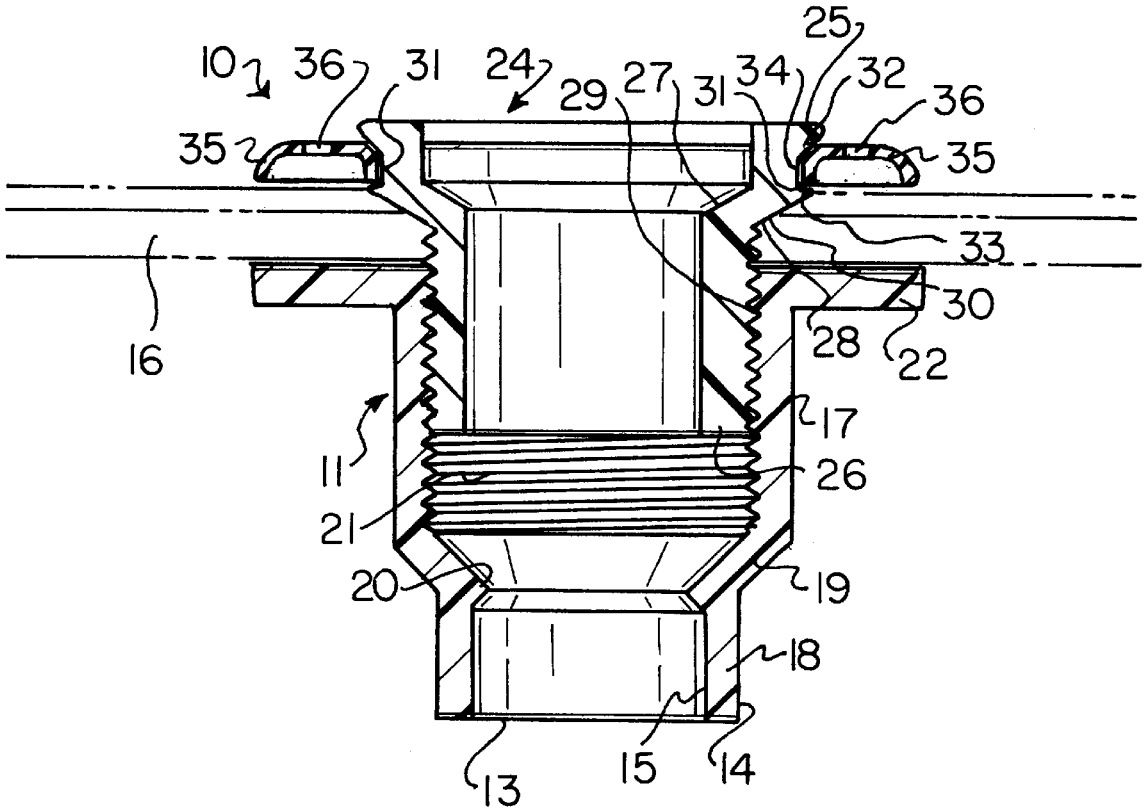
FIG. 2 is a schematic cross sectional view of the present invention taken from line 2—2 of FIG. 1 with the upper conduit threadably inserted into the lower conduit.

With reference now to the drawings, and in particular to FIGS. 1 through 2 thereof, a new adjustable closet flange embodying the principles and concepts of the present invention and generally designated by the reference numeral 10 will be described.

As best illustrated in FIGS. 1 through 2, the adjustable closet flange 10 generally comprises a tubular lower conduit with open top and bottom ends, and exterior and interior surfaces. The interior surface of the lower conduit has a threaded region located adjacent the top end of the lower conduit. The lower conduit also has an outwardly radiating annular mounting flange adjacent the top end of the lower conduit. A tubular upper conduit is proved having open upper and lower ends, and inner and outer surfaces. The outer surface of the upper conduit has a threaded region adjacent the lower end of the upper conduit. The lower end of the upper conduit is inserted into the top end of the lower conduit with the threaded region of the upper conduit threadedly engaging the threaded region of the lower conduit. The outer surface of the upper conduit has an annular outer groove therearound adjacent the upper end of the upper conduit. An annular bolt down flange is rotatably disposed about the upper conduit in the outer groove to permit free rotation of the bolt down flange about the upper conduit in the outer groove.

In use, the adjustable closet flange is designed for permitting fluid connection between a toilet and drain conduit. Specifically, the adjustable closet flange 10 comprises a tubular lower conduit 11 having generally circular open top and bottom ends 12,13, exterior and interior surfaces 14,15, and a longitudinal axis extending between the top and bottom ends of the lower conduit. As best illustrated in FIG. 2, the lower conduit is designed for insertion through a hole in a floor structure 16 formed adjacent an open upper end of a drain conduit.

The lower conduit has a generally circular transverse cross section taken in a plane substantially perpendicular to the longitudinal axis of the lower conduit. Preferably, the lower conduit has generally cylindrical top and bottom portions 17,18 and a generally frusta-conical middle portion 19 interposed between the top and bottom portions of the lower conduit. The top portion of the lower conduit is positioned adjacent the top end of the lower conduit. The bottom portion of the lower conduit is positioned adjacent the bottom end of the lower conduit.

The lower conduit has an outer diameter defined across the exterior surface of the lower conduit and an inner diameter defined across of the interior surface of the lower conduit. The outer diameter of the lower conduit in the top portion is greater than the outer diameter of the lower conduit in the bottom portion of the lower conduit. The inner diameter of the lower conduit in the top portion is greater than the inner diameter of the lower conduit in the bottom portion of the lower conduit.

The middle portion of the lower conduit tapers towards the bottom portion of the lower conduit. The interior surface of the lower conduit preferably has an inwardly radiating inner ridge 20 located at an union between the middle and bottom portions of the lower conduit. The inner ridge of the interior surface of the lower conduit ideally has a generally triangular transverse cross section taken in a plane in which the longitudinal axis of the lower conduit lies.

In use, the bottom portion of the lower conduit is designed for insertion into the open upper end of the drain conduit to fluidly connect the lower conduit to the drain conduit.

The interior surface of the lower conduit also has a threaded region 21 located in the top portion of the lower conduit. The threaded region extends between the top end of the lower conduit and the middle portion of the lower conduit.

The lower conduit has an outwardly radiating annular mounting flange 22 adjacent the top end of the lower conduit. The mounting flange of the lower conduit has a plurality of spaced apart generally circular mounting holes 23 therethrough. In use, the mounting flange of the lower conduit is designed for abutting adjacent an underside of the floor structure as best illustrated in FIG. 2. The mounting holes of the mounting flange are designed for upwardly extending fasteners therethrough and into the underside of the floor surface to fasten the mounting flange to the floor surface.

The adjustable closet flange also includes a tubular generally cylindrical upper conduit 24 having generally circular open upper and lower ends 25,26, inner and outer surfaces 27,28, and a longitudinal axis extending between the upper and lower ends of the upper conduit. The outer surface of the upper conduit has a threaded region 29 adjacent the lower end of the upper conduit.

The lower end of the upper conduit is inserted into the top end of the lower conduit to fluidly connect the upper conduit to the lower conduit. The threaded region of the upper conduit threadedly engages the threaded region of the lower conduit to threadably couple the upper conduit to the lower conduit. The threaded coupling of the upper conduit to the lower conduit permits a user to adjust of the distance between the upper end of the upper conduit and the bottom end of the lower conduit and more particular adjustment of the upper end of the upper conduit from the mounting flange of the lower conduit to fit various thickness' of floor structures.

The upper conduit preferably has a generally frusta-conical upper portion 30 adjacent the upper end of the upper conduit and which tapers in a direction towards the lower end of the upper conduit. The outer surface of the upper conduit has an annular outer groove 31 around the upper portion of the upper conduit. The outer groove of the outer surface of the upper conduit has a transverse cross section (taken in a plane in which the longitudinal axis of the upper conduit lies) comprising spaced apart top and bottom walls 32,33 and a side wall 34 connecting the top and bottom walls of the outer groove together.

With reference to FIG. 2, the side wall of the outer groove is extended substantially parallel to the longitudinal axis of the upper conduit. The bottom wall of the outer groove is extended substantially perpendicular to the longitudinal axis of the upper conduit. The top wall of the outer groove is positioned adjacent the upper end of the upper conduit and is extended at an acute angle to bottom wall of the outer groove.

An annular bolt down flange 35 is rotatably disposed about the upper portion of the upper conduit in the outer groove to permit free rotation of the bolt down flange about the upper conduit in the outer groove. The bolt down flange has generally circular inner and outer perimeters, and preferably a generally inverted-U-shaped transverse cross section taken in a plane in which the longitudinal axis of the upper conduit lies as shown in FIG. 2. The bolt down flange has a plurality of spaced apart generally circular securing holes 36 therethrough, and a plurality of spaced apart bolt slots 37 therethrough.

In use, the bolt down flange of the upper conduit is designed for abutting a topside of the floor surface such that the floor surface is interposed between the mounting flange of the lower conduit and the bolt down flange of the upper conduit. The bolt down flange also is designed for resting the wax bowl seal between the bolt down flange and the base of a toilet bowl. The securing holes of the bolt down flange are designed for downwardly extending fasteners therethrough and into the floor surface to fasten the bolt down flange to the floor surface. The bolt slots of the bolt down flange are designed for upwardly extending hold down bolts therethrough to secure the base of the toilet to the bolt down flange.

In an ideal embodiment, the upper and lower conduits preferably comprise a PVC material and the bolt down flange comprises a metal material.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable closet flange, comprising:

a tubular lower conduit having open top and bottom ends, exterior and interior surfaces;

said interior surface of said lower conduit having a threaded region located adjacent said top end of said lower conduit;

said lower conduit having an outwardly radiating annular mounting flange adjacent said top end of said lower conduit;

a tubular upper conduit having open upper and lower ends, inner and outer surfaces;

said outer surface of said upper conduit having a threaded region adjacent said lower end of said upper conduit;

said lower end of said upper conduit being inserted into said top end of said lower conduit, said threaded region of said upper conduit threadedly engaging said threaded region of said lower conduit;

said outer surface of said upper conduit having an annular outer groove therearound adjacent said upper end of said upper conduit; and an annular bolt down flange being rotatably disposed about said upper conduit in said outer groove to permit free rotation of said bolt down flange about said upper conduit in said outer groove.

2. The adjustable closet flange of claim 1, wherein said lower conduit has generally cylindrical top and bottom portions and a generally frusta-conical middle portion interposed between said top and bottom portions of said lower conduit, wherein said top portion of said lower conduit is positioned adjacent said top end of said lower conduit, and said bottom portion of said lower conduit is positioned adjacent said bottom end of said lower conduit.

3. The adjustable closet flange of claim 2, wherein said threaded region of said interior surface of said lower conduit is located in said top portion of said lower conduit.

4. The adjustable closet flange of claim 1, wherein said mounting flange of said lower conduit has a plurality of spaced apart mounting holes therethrough.

5. The adjustable closet flange of claim 1, wherein said upper conduit has a generally frusta-conical upper portion adjacent said upper end of said upper conduit, wherein said annular outer groove is positioned in said upper portion of said upper conduit.

6. The adjustable closet flange of claim 1, wherein said upper conduit has a longitudinal axis extending between said upper and lower ends of said upper conduit, wherein said outer groove of said outer surface of said upper conduit has a transverse cross section taken in a plane in which said longitudinal axis of said upper conduit lies comprising spaced apart top and bottom walls and a side wall connecting said top and bottom walls of said outer groove together, wherein said side wall of said outer groove is extended substantially parallel to said longitudinal axis of said upper conduit, wherein said bottom wall of said outer groove is extended substantially perpendicular to said longitudinal axis of said upper conduit, wherein said top wall of said outer groove being positioned adjacent said upper end of said upper conduit, and wherein said top wall of said outer groove being extended at an acute angle to bottom wall of said outer groove.

7. The adjustable closet flange of claim 1, wherein said bolt down flange has a plurality of spaced apart securing holes therethrough, and a plurality of spaced apart bolt slots therethrough.

8. An adjustable closet flange for permitting fluid connection between a toilet and drain conduit, said adjustable closet flange comprising:

a tubular lower conduit having generally circular open top and bottom ends, exterior and interior surfaces, and a longitudinal axis extending between said top and bottom ends of said lower conduit;

said lower conduit having generally cylindrical top and bottom portions and a generally frusta-conical middle portion interposed between said top and bottom portions of said lower conduit;

said top portion of said lower conduit being positioned adjacent said top end of said lower conduit, said bottom portion of said lower conduit being positioned adjacent said bottom end of said lower conduit;

said interior surface of said lower conduit having a threaded region located in said top portion of said lower conduit, said threaded region extending between said top end of said lower conduit and said middle portion of said lower conduit;

said lower conduit having an outwardly radiating annular mounting flange adjacent said top end of said lower conduit, said mounting flange of said lower conduit having a plurality of spaced apart generally circular mounting holes therethrough;

a tubular generally cylindrical upper conduit having generally circular open upper and lower ends, inner and outer surfaces, and a longitudinal axis extending between said upper and lower ends of said upper conduit;

said outer surface of said upper conduit having a threaded region adjacent said lower end of said upper conduit;

said lower end of said upper conduit being inserted into said top end of said lower conduit to fluidly connect said upper conduit to said lower conduit, said threaded region of said upper conduit threadedly engaging said threaded region of said lower conduit to threadably couple said upper conduit to said lower conduit;

said upper conduit having a generally frusta-conical upper portion adjacent said upper end of said upper conduit;

said outer surface of said upper conduit having an annular groove around said upper portion of said upper conduit;

said outer groove of said outer surface of said upper conduit having a transverse cross section taken in a plane in which said longitudinal axis of said upper conduit lies comprising spaced apart top and bottom walls and a side wall connecting said top and bottom walls of said outer groove together;

said side wall of said outer groove being extended substantially parallel to said longitudinal axis of said upper conduit;

said bottom wall of said outer groove being extended substantially perpendicular to said longitudinal axis of said upper conduit;

said top wall of said outer groove being positioned adjacent said upper end of said upper conduit, said top wall of said outer groove being extended at an acute angle to bottom wall of said outer groove;

an annular bolt down flange being rotatably disposed about said upper portion of said upper conduit in said outer groove to permit free rotation of said bolt down flange about said upper conduit in said outer groove; and said bolt down flange having a plurality of spaced apart generally circular securing holes therethrough, and a plurality of spaced apart bolt slots therethrough.

* * * * *